US006286822B1

(12) United States Patent
Blick

(10) Patent No.: US 6,286,822 B1
(45) Date of Patent: Sep. 11, 2001

(54) MACHINABLE SUPPORTS FOR CLOSE TOLERANCE EDGE SUPPORT

(76) Inventor: John Blick, 31891 Circle Dr., S. Laguna, CA (US) 92677

( * ) Notice: Subject to any disclaimer, the term of this patent is extended or adjusted under 35 U.S.C. 154(b) by 0 days.

(21) Appl. No.: 09/358,564

(22) Filed: Jul. 20, 1999

(51) Int. Cl.[7] ..... B25B 11/00

(52) U.S. Cl. ..... 269/21; 269/95; 269/296

(58) Field of Search ..... 269/21, 95, 296, 269/20; 451/388; 294/64.1; 279/3

(56) References Cited

U.S. PATENT DOCUMENTS

| | | | | |
|---|---|---|---|---|
| 3,520,055 | | 7/1970 | Jannett . | |
| 3,537,701 | | 11/1970 | Claycomb . | |
| 3,729,185 | | 4/1973 | Roeske . | |
| 3,907,268 | | 9/1975 | Hale . | |
| 4,934,672 | | 6/1990 | Craft . | |
| 5,203,547 | | 4/1993 | Marumo . | |
| 5,553,837 | * | 9/1996 | Kahle | 269/21 |
| 5,562,276 | | 10/1996 | Blick . | |
| 5,853,169 | * | 12/1998 | Hern et al. | 269/21 |
| 6,068,547 | * | 5/2000 | Lupi | 269/21 |

FOREIGN PATENT DOCUMENTS 1636175 3/1991 (RU) .

* cited by examiner

*Primary Examiner*—Robert C. Watson
(74) *Attorney, Agent, or Firm*—Curtis L. Harrington

(57) ABSTRACT

The devices and systems encompass the provision of a plurality of supports specially designed to closely support a work piece immediately adjacent the edge being worked, ground or polished. The top surfaces of the supports are machineable in place on the working table to insure that all are brought to exactly the same height to prevent adjacent supports from creating uneven support and adjacent shear forces. The top members of the supports are a hardened plastic which will not enable the work piece to displace downwardly but which will provide a vacuum downward force. The hardened plastic top of the edge hold down are machineable without losing the ability to act as a vacuum hold down. The shape of the hardened plastic top portions of the edge hold downs are complementary to each other and provide gently interlocking support and can be placed closely enough to eliminate the possibility of any significant amount of work piece area exposure which could produce shear forces. The gently interlocking shape of the edge supports facilitates their arrangement in a shape matching complex edge shapes of the work piece, including sharp corners and the like.

14 Claims, 7 Drawing Sheets

151
153
155
157
159
161
163
165
167
169
171
173
175
177
181
183
185
187
191
193
195
121
37
6

MACHINABLE SUPPORTS FOR CLOSE TOLERANCE EDGE SUPPORT

FIELD OF THE INVENTION

The present invention relates to improvements in the field of work piece holding devices for machines. More specifically, the present invention relates to a vacuum hold down device which is machineable upon installation and provides center and edge support needed for working thinner materials, especially for downward beveling grinding forces without failure or with extremely reduced incidence of failure.

BACKGROUND OF THE INVENTION

In many instances, it is necessary to locate, position and support a work piece which is to be milled, sanded, ground, etc. The precision and stability of the positional device is important, as is the ability to re-position the positional device. Positive location of a work piece is described in U.S. patent application Ser. No. 09/108,792 now U.S. Pat. No. 6,186,567 entitled "Automatic Clamping and Placement Holder" and which describes the use of an air and vacuum driven work piece holder which uses the positioning locator of a milling machine to locate the holder. The Automatic Clamping and Placement Holder works in conjunction with a system described in U.S. Pat. No. 5,562,276 entitled "Locator and Hold Down system for a Machine" which describes an integrated system for using holders. Both of these systems are incorporated herein by reference.

Most of the equipment described in the above references is sufficient for work pieces thicker than about 0.5 inches, even where downward forces are applied. For materials which are less than about 0.5 inches and especially for material which is less than 0.25 inches, the support of the material at the situs where the grinding tool operates on the work piece is a severe problem, especially where downward force is used. In larger pieces, support by a series of round vacuum hold downs located 2–3 inches from the outer edge has worked well.

In the thicker materials, the forces produced by the grinding tool at the edge of the work piece, are easily resisted in the volume of the work piece extending between the hold down and the worked edge. However, in thinner materials, a work piece support which is spaced 1–2 inches from the edge typically has a material strength that cannot withstand a bending moment on the length of material between the edge and the support.

Given the materials cost and the average amount of work time which goes into a work piece at failure, each failure has a significant cost in both materials cost, machine time, and labor required to clean up the breakage debris and re-load the machine.

Larger supports are simply not designed for the close-in location and spacing which would be needed to provide the close-in support, at the work piece edge to drastically reduce the material failure during the manufacturing process. Another reason that the larger supports are not utilizable is that their vacuum hold-down capability is usually achieved against a surface which is soft and therefore height variable, as well as frictionally deficient. Most hold downs have isolated circular or rectangular projections to form the support for the work piece. A vacuum is introduced around a cup surrounding the upper periphery of the support. The downward force is generated by the area of the upper periphery of the support which is evacuated, and limited only by the isolated circular projections. The rubber cup provides vacuum within its periphery but it does not provide support, even at its periphery. Thus even where grinding were to occur at the outer edge of a large vacuum support, which would be unadvisable and unsafe and too close to the rubber cup, a downward bending force over a one to two inch length of the material would still exist. Further, since most major supports are round and have a diameter of from about six to eight inches, there would be little coverage available between the main supports along a straight edge.

Another problem with close support of a work piece at its edge relates to the need to exactly control the height of closely spaced supports. Where one support is slightly taller or shorter than an adjacent support, the support itself can exert a harmful shear force on the material of the work piece and actually cause it to be more prone to failure during the grinding and polishing operation.

What is therefore needed is a support specially formulated to closely support a thin work piece near its edge, eliminating the rubber cut over extension seen in main supports, and which can provide even, secure support to a work piece.

SUMMARY OF THE INVENTION

The devices and systems of the present invention encompass the provision of a plurality of supports specially designed to closely support a work piece immediately adjacent the edge being worked, ground or polished, but especially an edge which is being beveled or some other type of material process where downward force is applied to the edge of the workpiece. The top surfaces of the supports are machineable in place on the working table to insure that all are brought to exactly the same height to prevent adjacent supports from creating uneven support and adjacent shear forces. The top members of the supports are a hardened plastic, such as polyvinylchloride (PVC), or a super hard rubber, or any other suitable machineable material which will not enable the work piece to displace downwardly but which will provide a vacuum downward force. The hardened plastic top of the edge hold down are machineable without losing the ability to act as a vacuum hold down. The shape of the hardened plastic top portions of the edge hold downs are complementary to each other and provide gently interlocking support and can be placed closely enough to eliminate the possibility of any significant amount of work piece area exposure which could produce shear forces. The smaller supports which are placed closely adjacent each other in conformance to the edge of the work piece provide additional support. In addition, the use of a gently partially interlocking shapes of the edge supports facilitates their arrangement in a shape matching complex edge shapes of the work piece, including sharp corners and the like.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
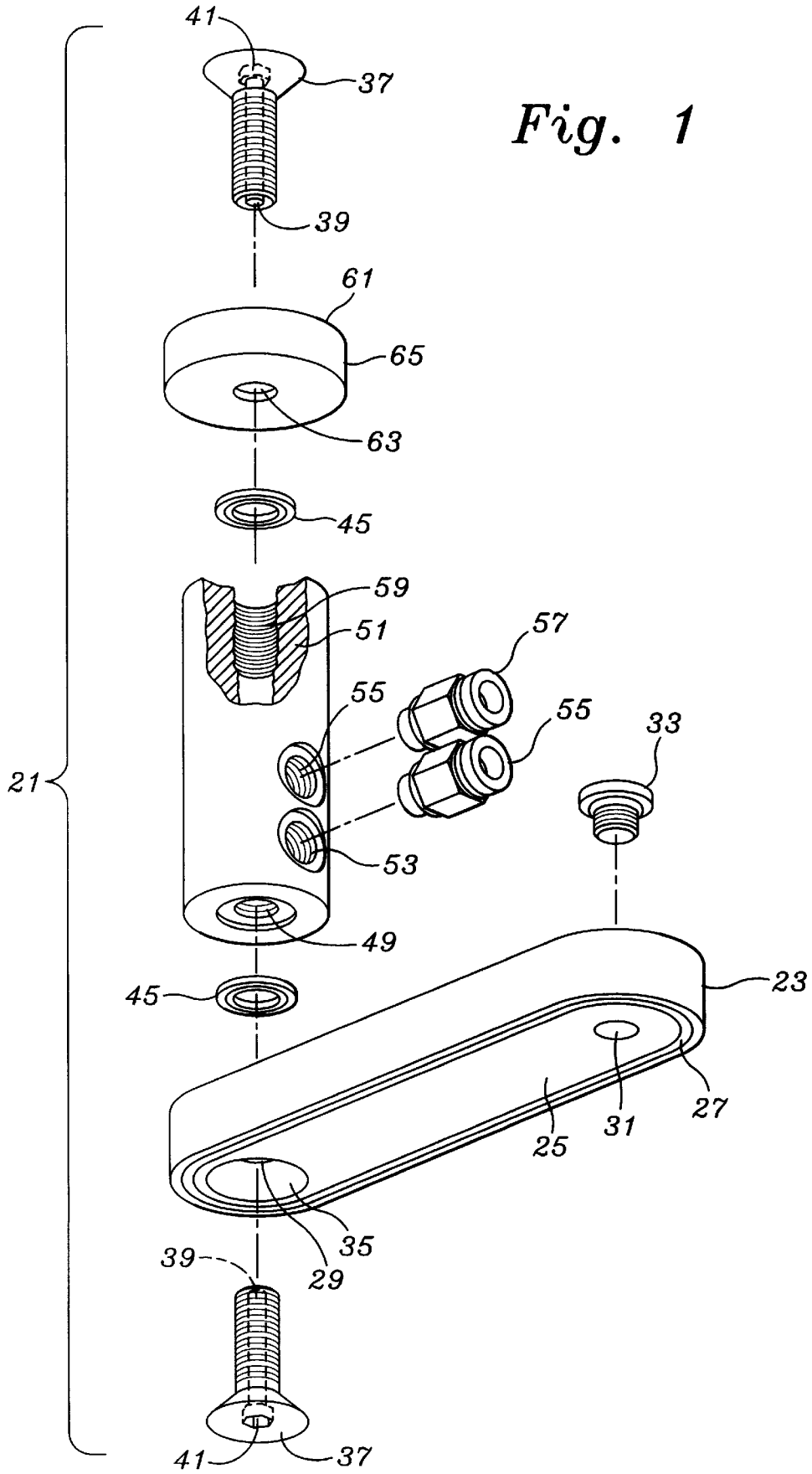
FIG. 1 is a perspective exploded view looking up at a vacuum support of the invention.

The description and operation of the invention will be best described with reference to prior art FIG. 1, which is a bottom perspective exploded view of an edge vacuum hold down support 21. Support 21 includes a base 23 having a lower surface 25 including a downwardly directed groove 27 extending about the lower surface 25 adjacent an outer peripheral edge. A pair of through bores 29 and 31 are formed in the base 23 and are useful for facilitating the formation of the support 21. Bore 31 is sealed off with a simple threaded plug 33. Bore 29 carries a chamfered surface 35 to accommodate an angled head of a hollow threaded member 37. Threaded member 37 has an internally located bore 39 which opens into a hexagonal opening 41 used to interfit a hex wrench or the like. A continuous "o" ring (not shown) fits within the downwardly directed groove 27.

At the left, a washer fitting 45 has a rubber inside and a metal outside and fits within a counterbore 47 about a threaded bore 49 of a columnar support 51. Into the columnar support 51, a lower threaded aperture 53 supports a threaded hose insertion fitting 53 which is in fluid pressure communication with the threaded bore 49. An upper threaded aperture 55 supports a threaded hose insertion fitting 57. In a partial sectional cutaway, the columnar support 51 can be seen as having a threaded bore 59 which is in fluid pressure communication with threaded hose insertion fitting 57.

Above columnar support 51, another washer fitting 45 underlies a round, re-dressable, machinable vacuum support member 61 having a bore 63, and a cylindrical side wall 65. Note that the base 23 is larger in one direction and configured to lend support to the relatively smaller re-dressable, machinable vacuum support member 61, yet base 23 is configured so that it can be positioned closely adjacent other supports 21 to both avoid interference with the beveling operation and adjacently located supports 21. The diameter of the re-dressable, machinable vacuum support member 61 is such that it can fit anywhere about an edge of a work piece. The diameter of the re-dressable, machinable vacuum support member 61 is about the same as or larger than the width of the base 23 to enable maximum vacuum holding force of the base 23. An important aspect of the invention is that the vacuum area of engagement of the base 23 should be larger then vacuum area of engagement of the re-dressable, machinable vacuum support member 61, but without interfering with the ability to place the supports 21 closely together along the edge of a work piece. Other configurations which meet this requirement are contemplated by the invention disclosed herein. The criticality of the invention For the vast majority of applications of the support 21 of the invention, a simple round machinable vacuum support member 61 will sufficiently support the edge of a work piece under beveling or other conditions where the edge receives downward bearing forces. A further threaded member 37 also having an internally located bore 39 opening into a hexagonal opening 41 is seen.

Figure 2:
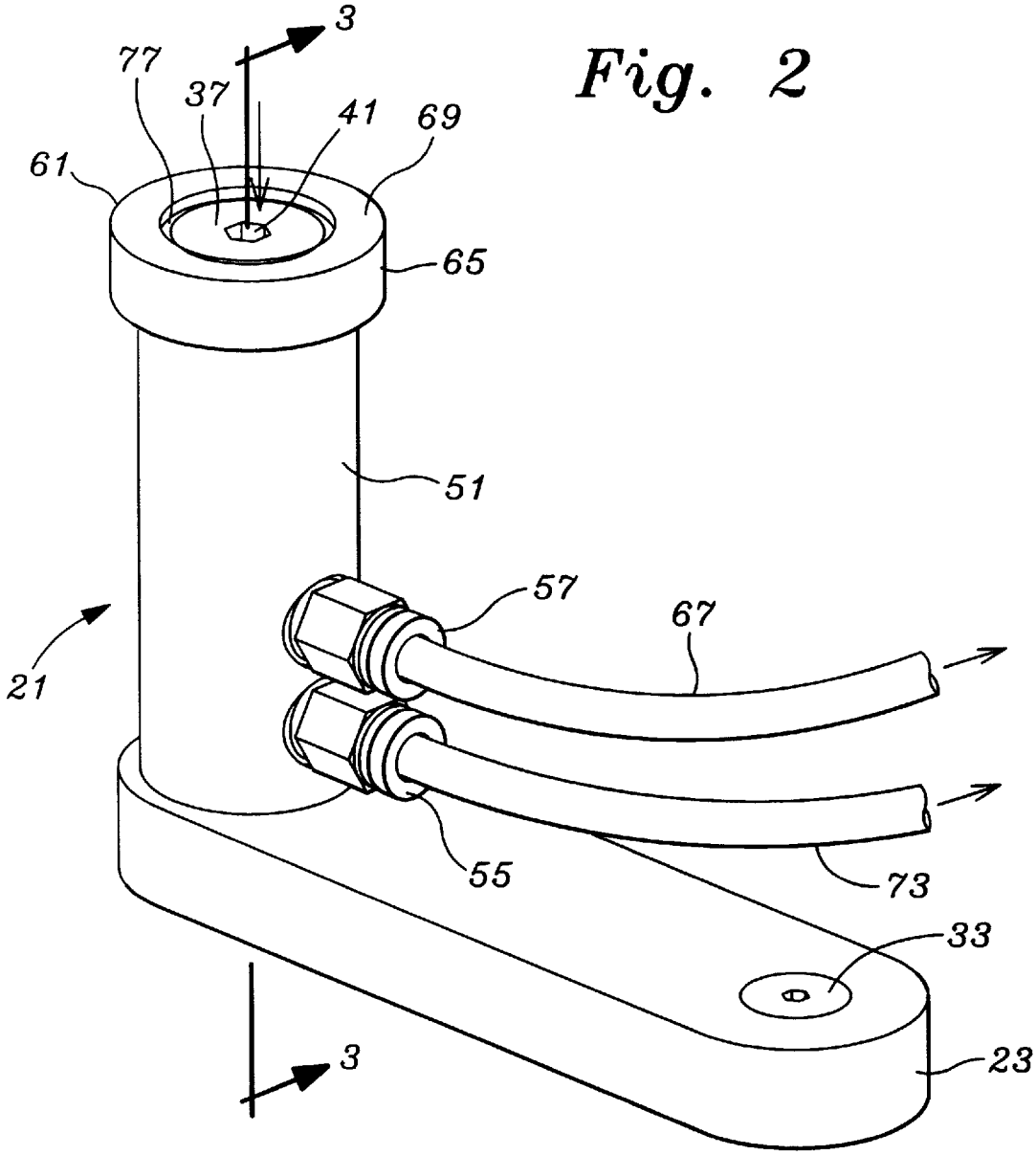
FIG. 2 is a perspective view looking down on the vacuum support seen in FIG. 1.

Referring to FIG. 2, a view of the support 21 is seen in assembled position and from an upper perspective. Hoses 67 connect to hose insertion fittings 55 & 57. Now seen is a top surface 69 of vacuum support member 61. Between the threaded member 37 and top surface 69, a chamfered surface 71 is partially seen. The chamfered surface 71 enables the head of threaded member 37 to complementarily engage the vacuum support member 61 and enables the head of the threaded member 37 to seat at a low enough position that there is plenty of material on the machinable vacuum support member 61 to be milled off for leveling several times over the life of the hold down support 21. If the amount of material removed from the top surface 69 brings the level of the top surface 69 too close to the top of the threaded member 37, the machinable vacuum support member 61 can simply be replaced by removing the threaded member 37 and adding a new support member 61. By the same fashion, vacuum support members 61 of other shapes can be interchanged atop the edge vacuum hold down support 21. However, frequent changing of the support member 61 in close tolerance demanding applications will require a re-milling or re-dressing of the substituted edge support 21, and frequent interchange is not recommended.

Figure 3:
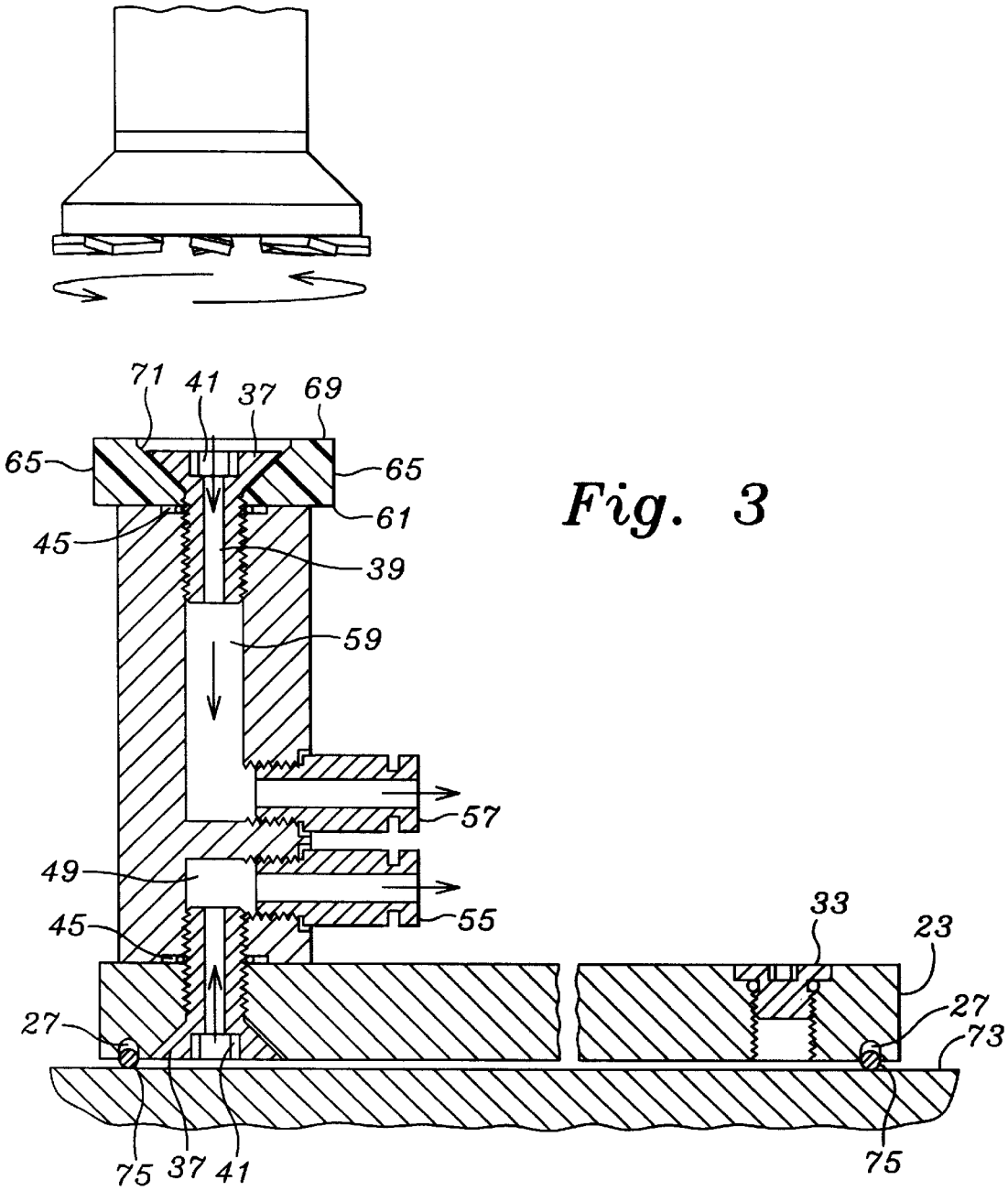
FIG. 3 is a sectional view of the vacuum support for supporting the edge of a work piece seen in FIGS. 1 & 2 taken along line 3—3 of FIG. 2.

Referring to FIG. 3, a side sectional view taken along line 3—3 of FIG. 2 illustrates the vacuum hold down edge support 21 with respect to a flat table surface 73 and illustrates an "o" ring 75 located within the downwardly directed groove 27. The fluid communication between the threaded hose insertion fitting 57 and bottom of the support 21 and between the threaded hose insertion fitting 57 and edge support member 61 is seen. Edge support member 61 is preferably made of a hardened plastic. Since the top surface 69 will be milled to a flat finish and since the edge support 21 typically works in a wet environment, the material of the edge support need not be soft to maintain and vacuum and in fact should rigid to insure that it provides a common level of support with edge supports 21 located next adjacent to it, it must have a constantly even and rigid support capability and to prevent a work piece from deflecting. FIG. 3 also illustrates the flat surface 69 with respect to a milling head which rotates and approaches the surface 69 to perform exacting milling material removal.

Figure 4:
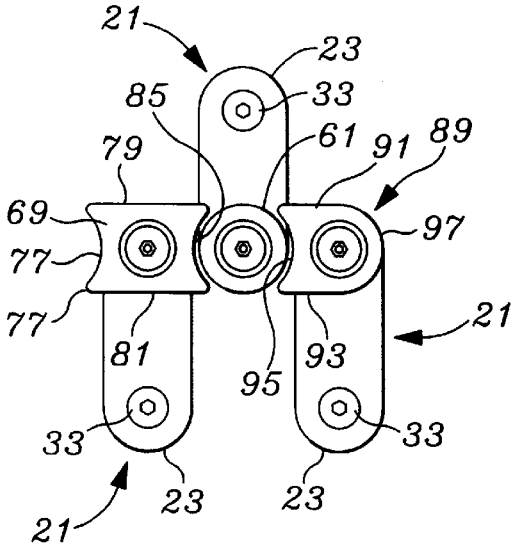
FIG. 4 is a top view of the supports seen in FIGS. 1–3 and illustrated with different machineable support members having shapes which cooperate and partially interfit with each other including a double concave shape, a round shape and a concave-convex shape.

Referring to FIG. 4 a top view of several of the supports 21 placed side by side illustrate how different shaped edge supports, such as edge support member 61 actually interfit loosely and interact. The use of different shaped edge supports enable a chain-like distribution when viewed from the top. The direction in which the base 23 extends with respect to the columnar support 51 is also optional, and dictated by the space available on a work table. In FIG. 4, the support 21 having edge support member 61 is seen in the middle. Adjacent and to the left is a support 21 having a machineable vacuum support member 77 having pair of oppositely oriented parallel side surfaces 79 and 81, as well as a pair of oppositely oriented concave side surfaces 83 and 85. The top surface of member 77 is still referred to with the numeral 69. Round edge support 61 has a cylindrical side surface 65 which complementarily fits adjacent to concave surface 85 of edge support member 77. To the extent that there is some overlap, not of the edge supports member 61 and 77, but of a crossing of a line between adjacent supports 21, an edge of a material to be worked at a given point may be supported by two edge supports member 61 and 77.

To the right of support member 61 is a support 21 having an edge support 89 having a pair of parallel sides 91 and 93, and a concave curved side 95 opposite a convex curved side 97. Convex curved side 97 has about the same curvature as the round side of support member 61 and can complementarily fit against side 65 of support member 61.

Figure 5:
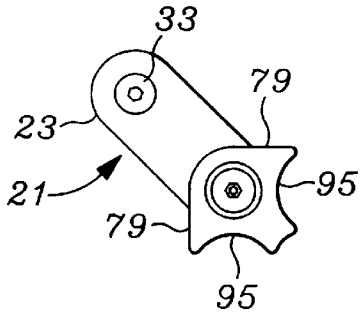
FIG. 5 is a perspective view of a two columnar support operable from vacuum fittings supported by a single one of the columnar supports.

Referring to FIG. 5 a corner shaped support member 99 has a pair of concave curved side surfaces 95 which are angled approximately 90° apart. A pair of flat sides 79, as were seen in FIG. 4,are also oriented at 90° apart. The orientation of the support member 99 can be rotationally varied with respect to the base 23 where necessary. Support 21 having support member 99 in combination with a pair of supports 21 having support members 99 can provide a general corner support which can provide slightly more interstitital support than a set of three supports 21 having support members 61.

Figure 6:
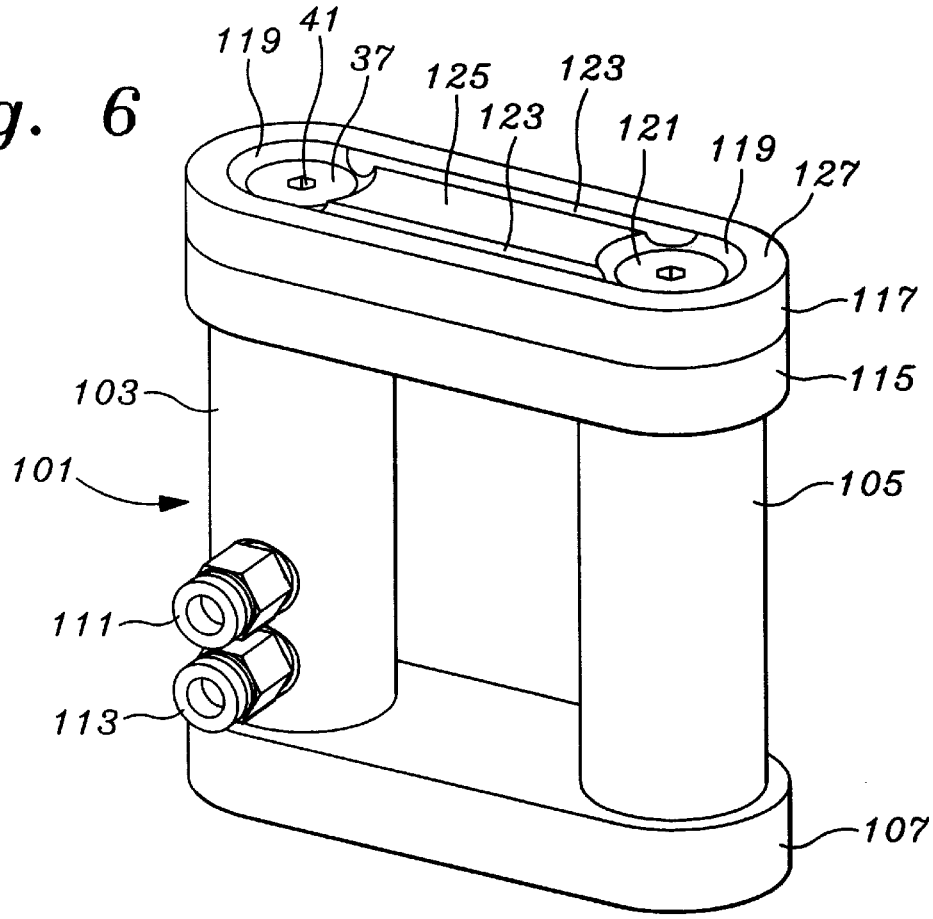
FIG. 6 is a bottom perspective view of the support seen in FIG. 5.

Referring to FIG. 6, a support 101 having two columnar supports 103 and 105 on a base 107 illustrates that only one columnar support, in this case columnar support 103 is necessary to supply vacuum both downwardly to hold the support 101 down, and upwardly to hold the work piece in place. An upper fitting 111 is in vacuum communication with hexagonal opening 41 of hollow threaded member 37. A lower fitting 113 is in vacuum communication with the bottom of base 107 in the same manner as that seen for support 21. At the top of the columnar supports 103 and 105, a common plate 115 evenly supports a long edge support 117 having chamfered surfaces 119 leading to openings, one of which accommodates hollow threaded member 37 which sits atop columnar support 103. A solid bodied threaded member 121 sits atop columnar support 105. No vacuum is pressurably transmitted through columnar support 105. A vacuum distribution groove 123 extends into the chamfered surfaces 119 to enable vacuum developed at the hollow threaded member 37 to be distributed to the area over the solid bodied threaded member 121. A top support surface 125 lies within the vacuum distribution structures 119 and 123, while a top support surface 127 lies peripherally outside of vacuum distribution structures 119 and 123. Thus, the top surface area of long edge support 117 is either providing a space in which vacuum is distributed or a surface which is utilized by a work piece to gather edge support.

Figure 7:
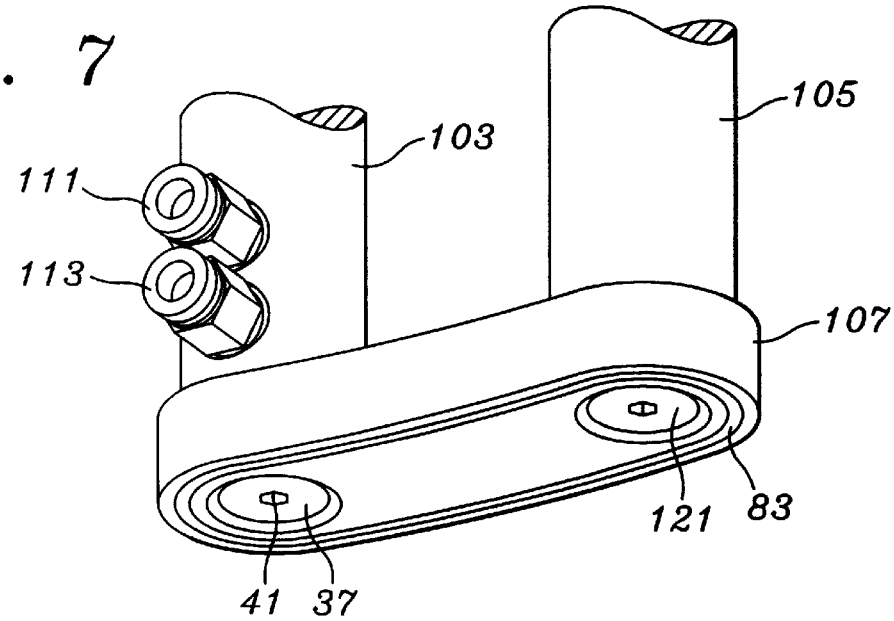
FIG. 7 is a top view of the support of FIGS. 5 and 6 to show the relative position of the vacuum distribution grooving and top support surfaces on either side of the vacuum distribution grooving.

Referring to FIG. 7, a bottom perspective of the support 101 illustrates that at the bottom, the hollow threaded member 37 is all that is necessary to introduce a source of vacuum from the lower fitting 113 into the space bounded by the "o" ring 83. Beneath columnar support 105, the solid bodied threaded member 121 is used.

Figure 9:
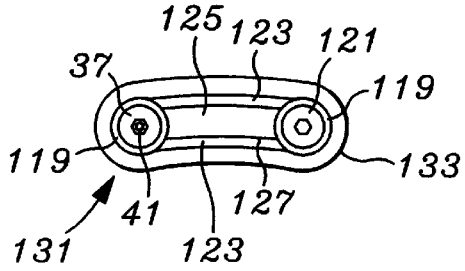
FIG. 9 is a top view of a curved version of a three columnar support similar to the support of FIG. 8.
Figure 8:
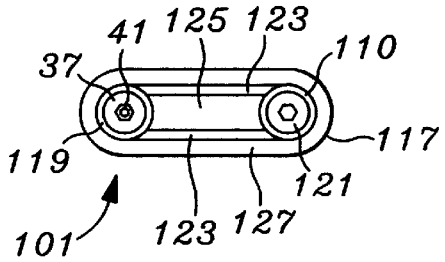
FIG. 8 is a top view of a curved version of a two columnar support similar to the support of FIGS. 5–7 for comparison to FIG. 7.

Referring to FIG. 8, a top reduced view of support 101 is seen. Referring to FIG. 9, a top reduced view of a curving support 131 is seen, with the same top surface features, but having a curved shape, including a gently curved long edge support 133. Although not seen in FIG. 8, the structures corresponding to the common plate 115 and base 107 of FIG. 6 are similarly curved with respect to support 131.

Figure 10:
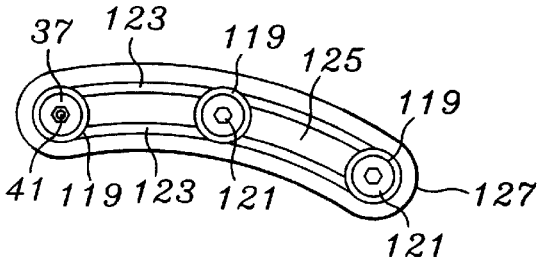
FIG. 10 is a perspective view of a circular support utilizable as a main support for thin work pieces and having a machineable top material having vacuum distribution grooves and an outer rubber cup.

Similarly, and referring to FIG. 10 a top reduced view of support 141 which is gently curving as was support 131, but having three columnar supports (not seen) is seen. A gently curved long edge support 143 is seen. Again, only one of the columnar supports nee be available to supply a source of vacuum to the bottom of the base and top of the gently curved long edge support 143. Only one hollow threaded member 37 need be present. The other structures of the gently curved long edge support 143 are numbered in accord with that seen in FIG. 9. A similar support as that seen for support 141 could be made with a straight shape as was seen in FIG. 7 for support 101, but with three columns. Other multiple column and multiple shapes are possible.

As has been recited, the hold downs for thin work pieces which are not of exacting common heights will create :problems. A hold down with a reduced frictional area can introduce unwanted slip for a given level of friction in the material. A hold down which has a support height which is not precise could on its own create breakage of material. A main hold down is usually placed near the center or a series of centroid locations of the work piece. It is usually meant to stabilize the work piece, but where edge supports are employed, a central support which is not similarly machined to similar tolerances could create breakage problems. Further, even where milling of the modest area portions of the main hold downs is possible, simple downward pressure at the middle of a work piece is not likely to provide the necessary resistance to movement especially needed by a thin work piece.

Figures 11, 12:
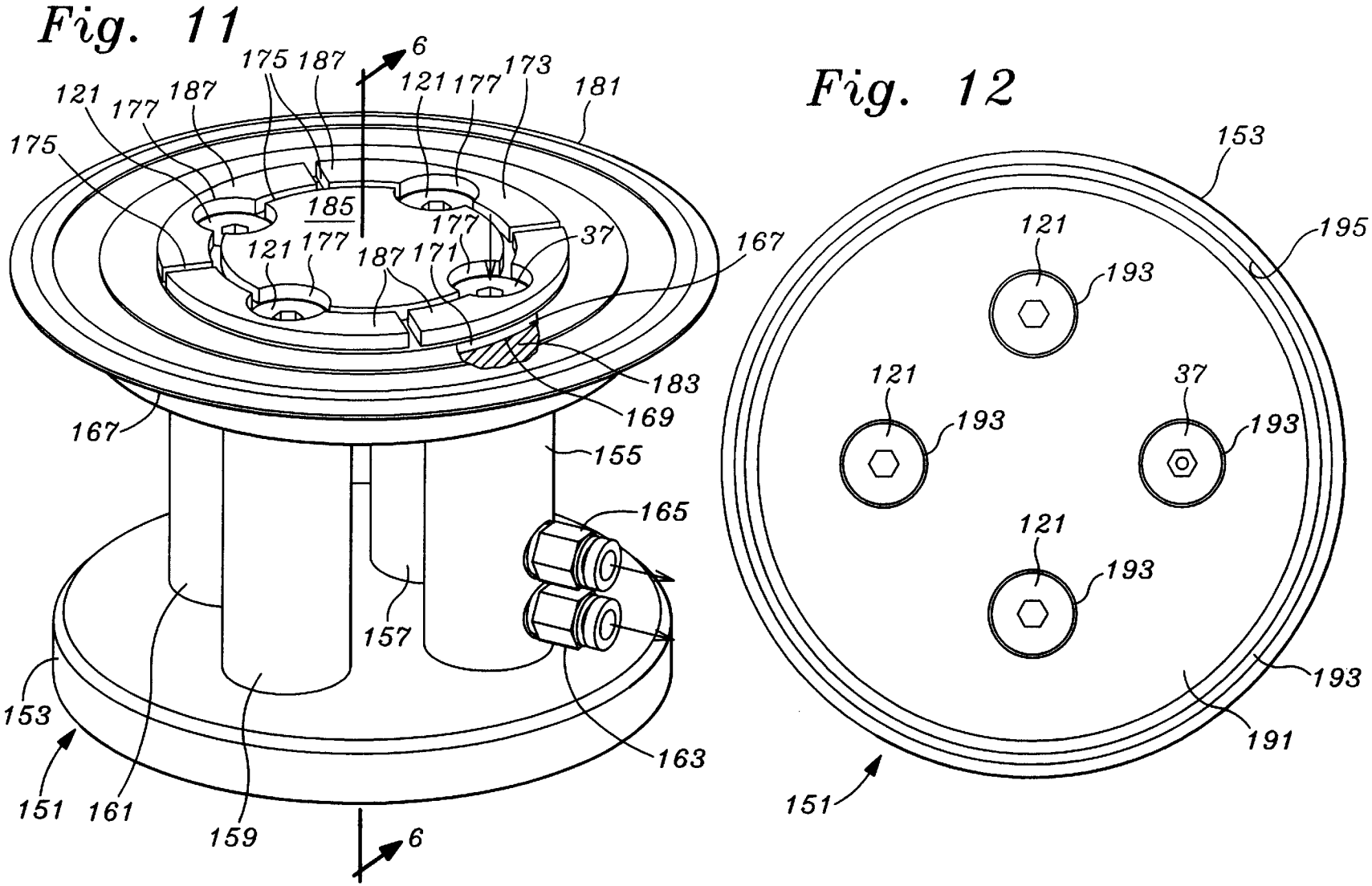
FIG. 11 is a bottom view of the support seen in FIG. 10.
FIG. 12 is a top view of an edge support similar to that of FIGS. 9 and 7 but in which the machinable edge support member is straight, and for which sits atop columnar members supported by an expanded base to provide additional vacuum holding support.

Referring to FIG. 11, a central support 151 includes a base 153, columnar supports 155, 157, 159 and member 61 arranged in a square pattern. Columnar support 155 supports a lower threaded hose insertion fitting 163 and an upper threaded hose insertion fitting 165. Columnar supports 155, 157, 159 and member 61 support an upper support plate 167 having a space 169 into which a plate 171 fits. Plate 171 has a thickness of machineable material 173 adhered thereto.

Machineable material 173, which preferably is a very hard rubber material, includes vacuum distribution channels 175 connecting four main apertures 177 in the machineable material 173 which overlie 4 chamfered apertures in the plate 171 for engagement with three solid bodied threaded member 121 and one hollow threaded member 37. The upper support plate 167 is surrounded by an over fitting rubber cup 181 which sits generally lower than the machineable material 173 in order that vacuum may be effectively transmitted to it through the radially positioned vacuum distribution channels 175. A raised rim 183 about the outermost periphery of the rubber cup 181 is positioned to engage a work piece, seal against it and provide a peripheral seal against air entering the cup 181. Since nearly all of the area within the raised rim 183 is evacuated, a large downward force is produced. The machineable material 173 includes a relatively large area including a main central expanse 185 and a series of curved expanses 187. Expanses 185 and 187 provide the surface area of friction and proper machined height to hold a work piece level in immovable. In the machining operation, the removable cup 181 is removed, especially since its rim 183 typically rests in an upwardly urged position.

Referring go FIG. 12, a bottom view of support 151 illustrates a bottom surface 191 with four chamfered apertures 193 into which fit three solid bodied threaded member 121 and one hollow threaded member 37. A peripherally extending "o" ring 193 rests within a groove 195 to provide a seal to enable vacuum introduced through the hollow threaded member 37 to hold the support 151 down to a work table surface.

Figure 13:
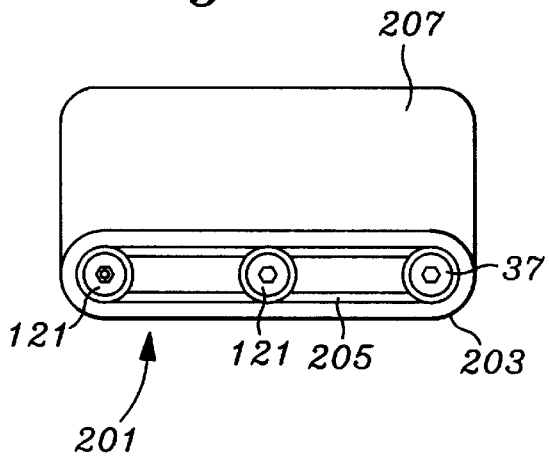
FIG. 13 is a top view of a support having an enlarged base 207 which projects laterally in one direction.

Referring to FIG. 13, a support 201 has a straight edge support 203, and vacuum distribution grooves 205. However, support 201 has an enlarged base 207 which projects laterally in one direction. Enlarged base 207 is nothing more than an expansion to provide increased resistance to pushing of a work piece. Although shown generally as rectangular, the support 201 could have an overall curvature, along with a curvature of the edge support 203

Figure 14:
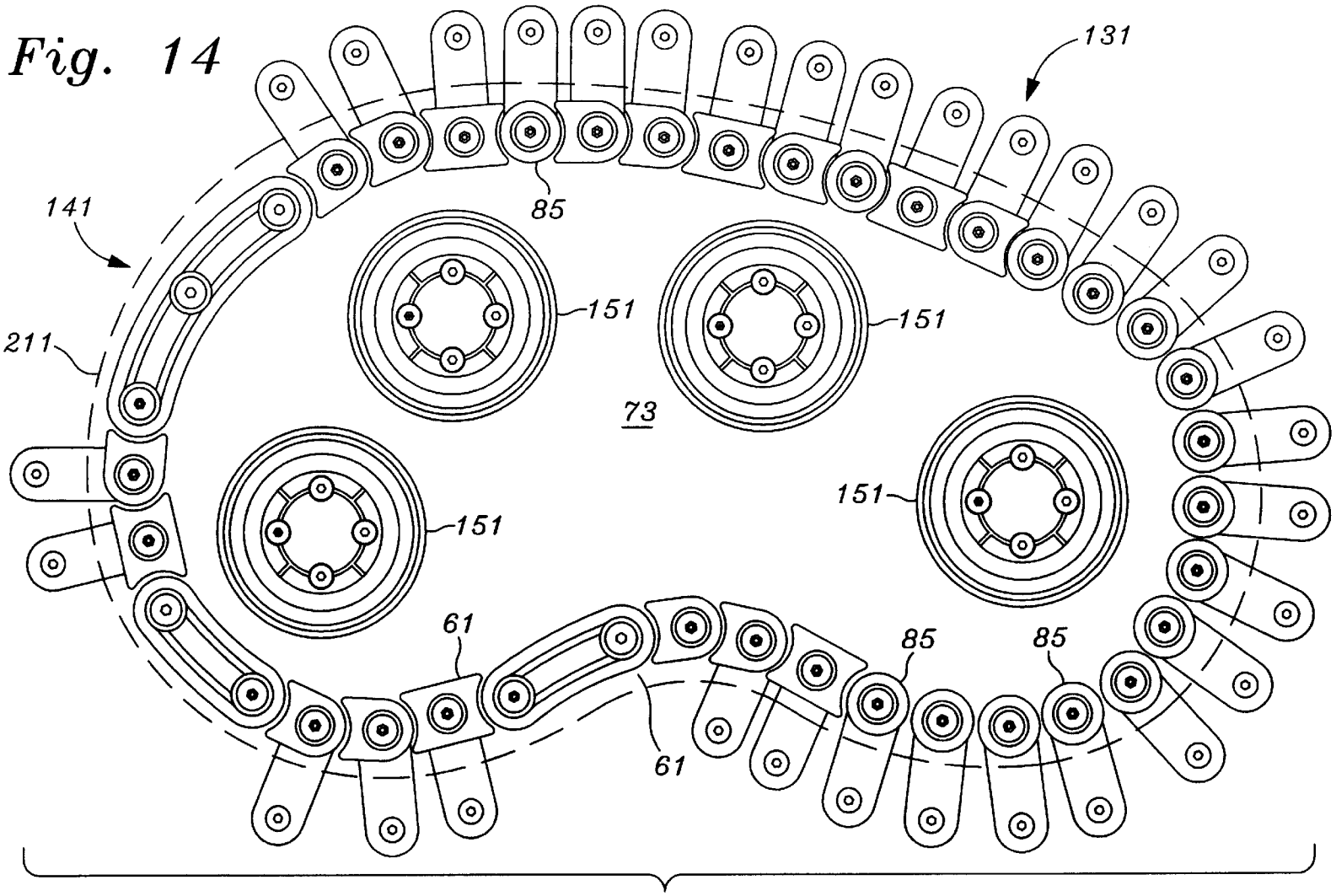
FIG. 14 is a plan view overlooking a work setup shown as a kidney shaped glass piece to be cut or polished about its periphery as a representative of a complex shape and which has a combination of the types and shapes of both main supports and edge supports seen in the previous Figures and employed to conform to the kidney shape to provide closely toleranced holding force for the glass table while it is being worked, machined, polished, etc.

Referring to FIG. 14, a top view looking down onto a working surface 81 illustrates a typical set up for beveling the edge of a kidney shaped glass work piece 211 shown over a motley selection of supports assembled to follow as closely as possible to the edge of the glass work piece 211. All of the supports 21 may have round support member 61. To illustrate, a significant part of the periphery of the kidney shaped glass work piece 211 is supported solely by round support members 61. The vacuum hoses 73 are eliminated, as are a more detailed numbering which would obscure FIG. 13 if all of the structures shown were numbered. Larger units, such as support 141 and 131 should be utilized where possible for ease of positioning and reduced handling of the relatively smaller supports 21.

While the present invention has been described in terms of a device and system used in conjunction with securing work pieces for all types of process machinery, and in particular with machinery for the milling, edging and machining of materials including glass, granite, marble, stone, and the like, one skilled in the art will realize that the structure and techniques of the present invention can be applied to many appliances. The present invention may be applied in any situation where the position of relatively less thick work pieces is desired to be precisely secured to reduce breakage and to reduce lost time.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A support for supporting a work piece at its edge comprising:

a base having an upper side and a lower side including a continuous groove supporting a vacuum seal seated in and extending from said continuous groove for creating a vacuum against a surface upon which said lower side of said base is placed;

a columnar support extending from said upper side of said base having a first vacuum fitting for introducing an external source of vacuum for communication with at least one of said machinable support member and said vacuum seal; and a machinable support member atop said columnar support for creating a vacuum against a work piece to be supported by said machinable support member and wherein said columnar support has an axial bore in communication with said vacuum fitting and wherein said machinable support member atop said columnar support has an opening in communication with said axial bore of said columnar support to transmit vacuum from said vacuum fitting to said machinable support member and wherein said axial bore of said columnar support adjacent said machinable support member is threaded and further comprising a bolt having a central through bore and engaged within threaded axial bore of said columnar support and engaging said machinable support member onto said columnar support and wherein said vacuum is transmitted through said central through bore of said bolt.

2. The support for supporting a work piece at its edge as recited in claim 1 and further comprising a second vacuum fitting associated with said support for supporting a work piece at its edge in communication with and for introducing an external source of vacuum for said vacuum seal.

3. The support for supporting a work piece at its edge as recited in claim 2 wherein said first and second vacuum fittings are commonly supported by said columnar support.

4. The support for supporting a work piece at its edge as recited in claim 1 wherein said machinable support member is in the shape of a double concave rectangle having two opposing sides parallel to each other and two opposing concave sides.

5. The support for supporting a work piece at its edge as recited in claim 1 wherein said machinable support member is in the shape of a circle.

6. The support for supporting a work piece at its edge as recited in claim 1 wherein said machinable support member is in the shape of a concave and convex rectangle having a first pair two opposing sides parallel to each other and a second pair of two opposing sides one of which is a concave side and one of which is a convex side.

7. The support for supporting a work piece at its edge as recited in claim 1 wherein said machinable support member atop said columnar support includes a vacuum distribution groove on a top surface thereof.

8. The support for supporting a work piece at its edge as recited in claim 1 wherein said machinable support member is made of polypropylene.

9. The support for supporting a work piece at its edge as recited in claim 1, and wherein said machinable support member further comprises:

a support plate supported by said at least one columnar support and supporting said machinable support member.

10. The support for supporting a work piece as recited in claim 9 wherein said machinable support member extends to the edge of said support plate to enable said work piece to supported near an edge of said work piece.

11. The support for supporting a work piece as recited in claim 9 wherein said machinable support member includes vacuum distribution grooves in a top side of said machinable support member to enable a vacuum applied to said machinable support member to be distributed over said top side of said machinable support member.

12. The support for supporting a work piece as recited in claim 9 wherein said support plate supported by said at least one columnar support includes a space and further comprising a plate having said machineable material attached thereto, said plate fitting in to said space.

13. The support for supporting a work piece as recited in claim 9 and further comprising an elastomeric collar fittable adjacent an outer edge of said support plate to facilitate a holding of vacuum over said support plate and underneath said work piece.

14. The edge support as recited in claim 9 wherein said machinable support member is in the shape of a circle.

* * * * *